US006283702B1

(12) United States Patent
Devlugt et al.

(10) Patent No.: US 6,283,702 B1
(45) Date of Patent: Sep. 4, 2001

(54) DRILL ROD LOADER

(75) Inventors: Paul Devlugt, Val Caron; David Lloyd Hoover, Hamilton, both of (CA)

(73) Assignee: Inco Limited, Toronto (CA)

( * ) Notice: Subject to any disclaimer, the term of this patent is extended or adjusted under 35 U.S.C. 154(b) by 0 days.

(21) Appl. No.: 09/252,351

(22) Filed: Feb. 17, 1999

(51) Int. Cl.[7] ..... E21B 19/14
(52) U.S. Cl. ..... 414/745.7; 175/85; 414/800
(58) Field of Search ..... 175/52, 85, 162; 414/22.62, 22.71, 745.7, 800

(56) References Cited

U.S. PATENT DOCUMENTS

| | | | | |
|---|---|---|---|---|
| 4,703,811 | * | 11/1987 | Lam | 175/85 X |
| 4,834,195 | * | 5/1989 | Robinson | 414/22.62 X |
| 5,018,588 | * | 5/1991 | Haberer | 175/85 X |
| 5,263,545 | * | 11/1993 | Tudora et al. | 175/52 |
| 5,303,783 | * | 4/1994 | Begnaud et al. | 175/85 X |
| 5,575,344 | | 11/1996 | Wireman | 175/85 |
| 5,622,232 | * | 4/1997 | Whisenhunt | 175/85 |
| 5,762,150 | * | 6/1998 | Cheng et al. | 175/85 X |
| 5,791,822 | | 8/1998 | Edmondson et al. | 405/259.1 |

OTHER PUBLICATIONS

"Directional Drilling", Jun. 1998 (entire magazine).
Hutte & Co. Bohrtechnik Anchor Rig HBR 506 (date unknown) 1 page.
Val D' or 3000 B Hydrualic Diamond Drill (date unknown) 2 pages.
Diamec® 262—Atlas Copco (date unknown).

* cited by examiner

*Primary Examiner*—Janice L. Krizek
(74) *Attorney, Agent, or Firm*—Edward A. Steen

(57) ABSTRACT

An automated drill road loader particularly suited for thin walled drill rods. The loader, generally affixed to a drill, includes an open frame sufficiently wide to accommodate and store drill rods. A clamp rod gripper and a swing gripper consisting of two pendulums are affixed to a side of the frame. A lift first raises a stored rod from the open frame. The rod is then grasped by the clamp rod gripper and the swing gripper to index the rod in a drill mast. By sequentially manipulating and translating the clamp rod gripper and the swing gripper, the rod is carefully held for threading. The drill rod may be establishing a new drill string or it may be inserted into an existing drill string.

12 Claims, 9 Drawing Sheets

50
8
88
92
90
58
8
54
56
C 50
92
92
102

DRILL ROD LOADER

TECHNICAL FIELD

The instant invention relates to drilling equipment in general, and more particularly, to a rod loader for automatically indexing and connecting additional drill rods to an existing drill string or establishing a new drill string.

BACKGROUND ART

Diamond core drills, as with other types of drills, use multiple drill rods to bore into the earth.

Typically, the drill is actuated and drilling commences until a fixed length of drill rod has traveled through a predetermined distance into the ground. At this point, the drilling operation ceases; the drill string connection is broken at a number of locations; the water swivel connections are uncoupled; and an additional drill rod is laboriously inserted into the string at the drill proper. Drilling commences again until the next rod is required.

The stop and start regimen of the drilling cycle leads to downtime and inefficiency. Most drill strings must be manually loaded by at least one operator. The drill must be stopped; the connections broken; water lines disconnected; the new rod carefully threaded to an existing rod; the appropriate connections reattached; and the drill powered up.

Besides being a physically demanding job, the business of loading heavy and clumsy drill rods is dangerous to personnel. Moreover, care must be taken to protect the threads at the ends of the drill rods. Stripping and cross-threading can easily occur due to misalignment and excessive torquing rendering the affected rods useless at the job site.

In particular, diamond core drills use multiple drill rods to drill holes. These drills can operate in any orientation and direction. Vertically upward drilling presents an extra challenge to the diamond driller since the drill string can fall out of the drill hole while rods are being added.

Attempts have been made to automate heavy drill rod loading so as to reduce the possibility of injury to personnel and equipment while increasing productivity.

Essentially an automated rod changer must bring a drill rod, typically four inches (10.2 cm) or greater in diameter with heavy tapered threads, into station, index the existing rod into the proper position reliably and accurately, start the threading process, fully torque the rod into its neighbor and the rotary drill drive and recouple the water lines. Upon completion of the loading cycle, the drill commences drilling until the next rod is required whereupon the stop/load/start cycle is started anew.

Representative designs are taught in U.S. Pat. Nos. 5,791,822 and 5,575,344.

Another drilling technology that utilizes automated drill string decouplers is directional drilling (also called trenchless technology).

This type of drill is used for laying utility piping under highways and buildings without having to disturb the surface. A drill is set up and the rods pushed into the soil at a shallow angle. The bit is angled on the front and can be rotated to send it in a new direction. These drills use two clamps that can be rotated with respect to each other; this allows one to unthread the bottom joint. The rotation units on these drills typically use a top drive head, which means the rod at the head is permanently attached. These systems utilize rods with heavily tapered threads to ensure alignment of the rods during threading operations.

The aforementioned designs are not applicable for small diameter thin walled drill rods.

In particular, wireline diamond core drills that utilize retrievable drill core samples typically employ rods of small diameter, such as AQ size rod. AQ wireline rods are 1.75 inches (4.45 cm) in diameter with a 1.375 inch (3.5 cm) inside diameter. These relatively thin walled rods have light threads that are easily damaged.

In contrast to heavy threaded rods that are somewhat tolerant of initial misalignment and relatively rough handling prior to threading, thin walled rods must be perfectly aligned and lightly torqued prior to engagement. Otherwise the threads will become crossed and stripped.

SUMMARY OF THE INVENTION

There is provided an automated drill rod loader especially useful for thin walled drill rods.

The loader is designed to be affixed to typical commercial drill masts such as omnidirectional diamond core drills.

The loader may include a drill mast mount, an elongated open frame, a rod cartridge capable of storing a plurality of rods and two transfer arms affixed to the frame. One transfer arm includes a movable swing gripper. The second transfer arm includes a clamp rod gripper.

The swing gripper and the clamp rod gripper operate in tandem to grab a rod and hold it in place while threading. Independent actuation of the transfer arms allows for a handling sequence that avoids cross threading the rods that are sensitive to misalignment. The transfer arms are hinged and removable so as to maintain the work envelope for other operations requiring the drill.

PREFERRED EMBODIMENT OF THE INVENTION

Figure 1:
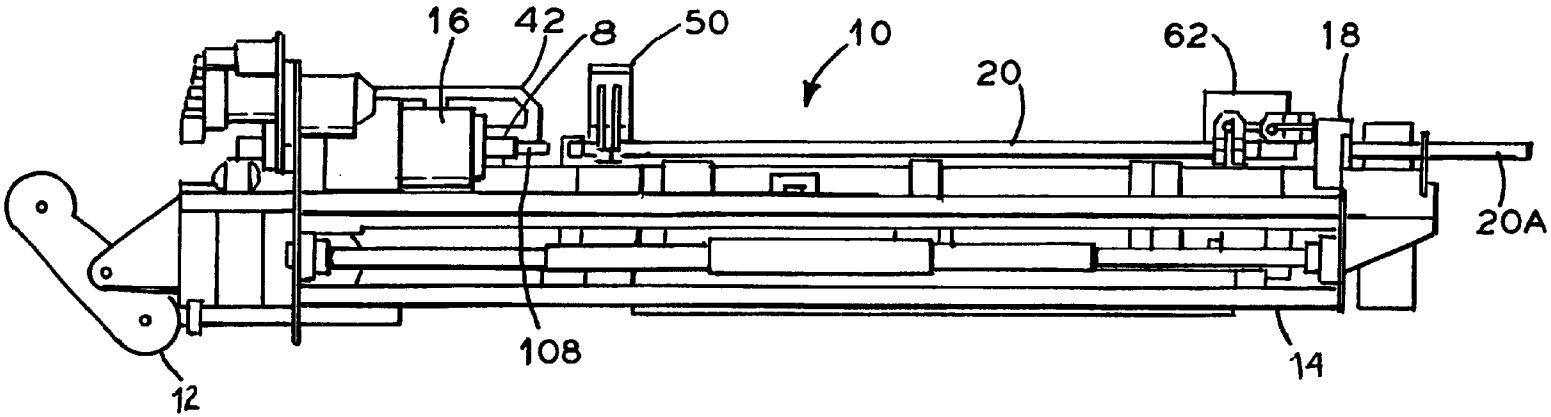
FIG. 1 is an elevation of an embodiment of the invention mounted on a drill mast.

Referring to FIG. 1 there is shown a drill rod loader 10 affixed to a schematic representation of a commercial drill 12.

The drill 12, partially shown, includes a mast 14, a rotation drive 16, a foot clamp 18 and other conventional drilling accouterments found in commercially available drills 12.

The drill rod loader 10, depicted in greater detail in the following figures, is adapted to be mounted to the mast 14 of the drill 12 in any conventional fashion using attachment members known to those skilled in the art, i.e. bolts, screws, weldments, rivets, etc. A drill rod 20 is shown stored in the loader 10.

As was discussed previously, the rod loader 10 may be attached to any earth boring drill 12. In particular, the rod loader 10 is shown affixed to a diamond drill 12 that is capable of drilling in any orientation.

The rods in question, used for water flushed wireline drilling, are generally thin walled tubes having less than robust threads. Accordingly, care must be exercised in making and breaking coupled connections.

Typically, the rotation drive 16 slowly propels the drill rod 20 into the excavation along with the corresponding water swivel/head combination (not shown). Drilling eventually ceases, the rotation drive 16 is uncoupled from the last rod and retracted by sliding it up the mast 14 (as shown in FIG. 1).

A new rod is supported in place whereas the water swivel 8 and the rotation drive 16 are attached to the new rod. The rotation drive 16 then slowly and carefully makes the foot joint connection between the existing rod 20A and the new rod 20.

The foot clamp 18 holds the existing rod 20A securely in place when the connections are both made and broken. Moreover, the foot clamp 18 will prevent the drill string from falling out of an up hole.

Upon completion of the new rod insertion and threading operations, the rotation drive 16 is again energized and the drilling operation recommences.

Presently, the aforementioned procedure is primarily conducted by hand. A single rod would be physically placed in position by the operator. The make cycle wherein the new rod is threaded and torqued to an existing rod must be carefully controlled by the operator to prevent damage to the threads.

This manual sequence is inefficient, time consuming and requires the assistance of a trained operator who is constantly carrying pipe and carefully making and breaking the connections. Besides safety considerations, it is highly useful to expedite the drilling operation by utilizing the automated rod loader 10.

Figure 2:
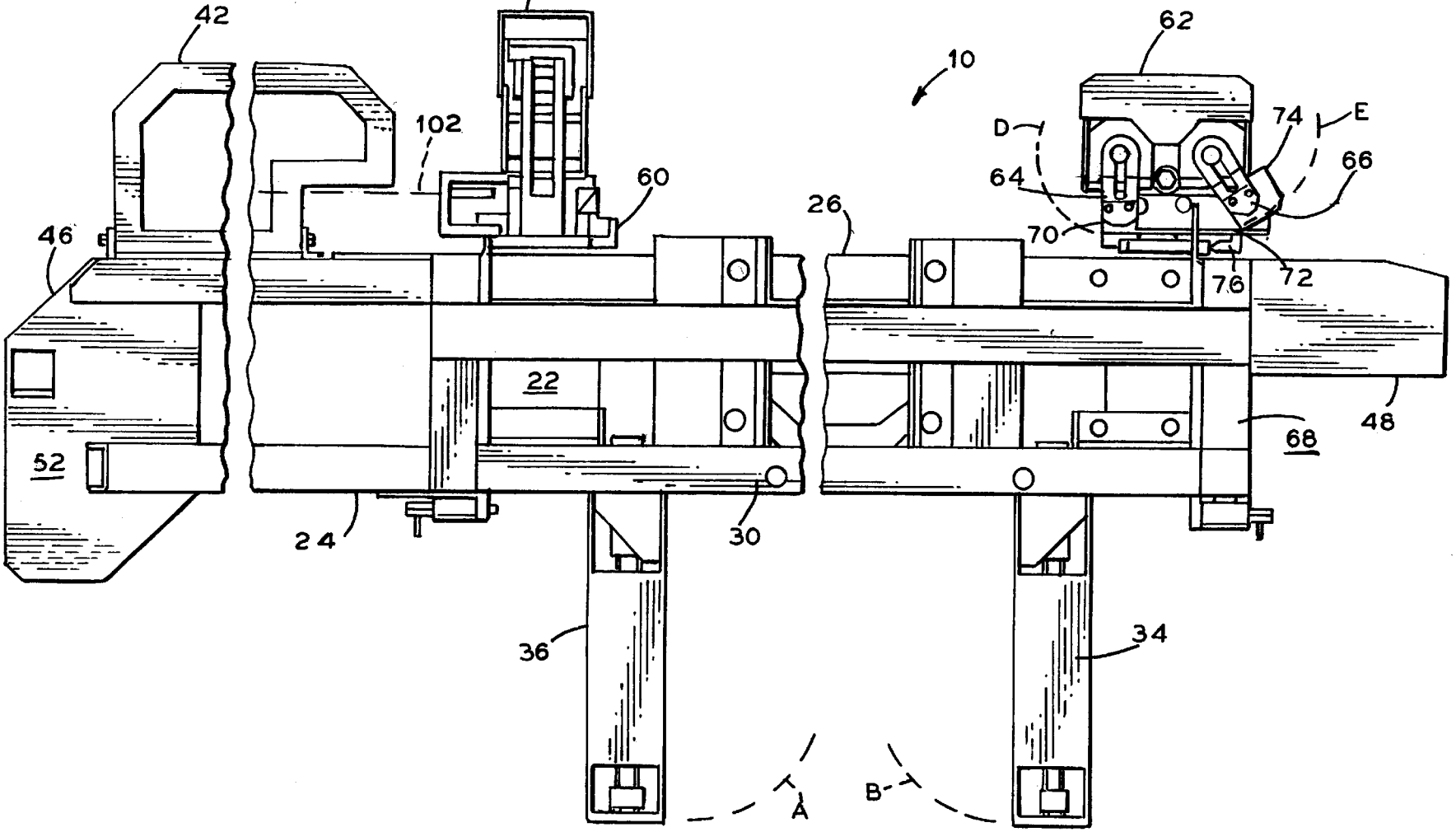
FIG. 2 is an elevation of an embodiment of the invention.
Figure 3:
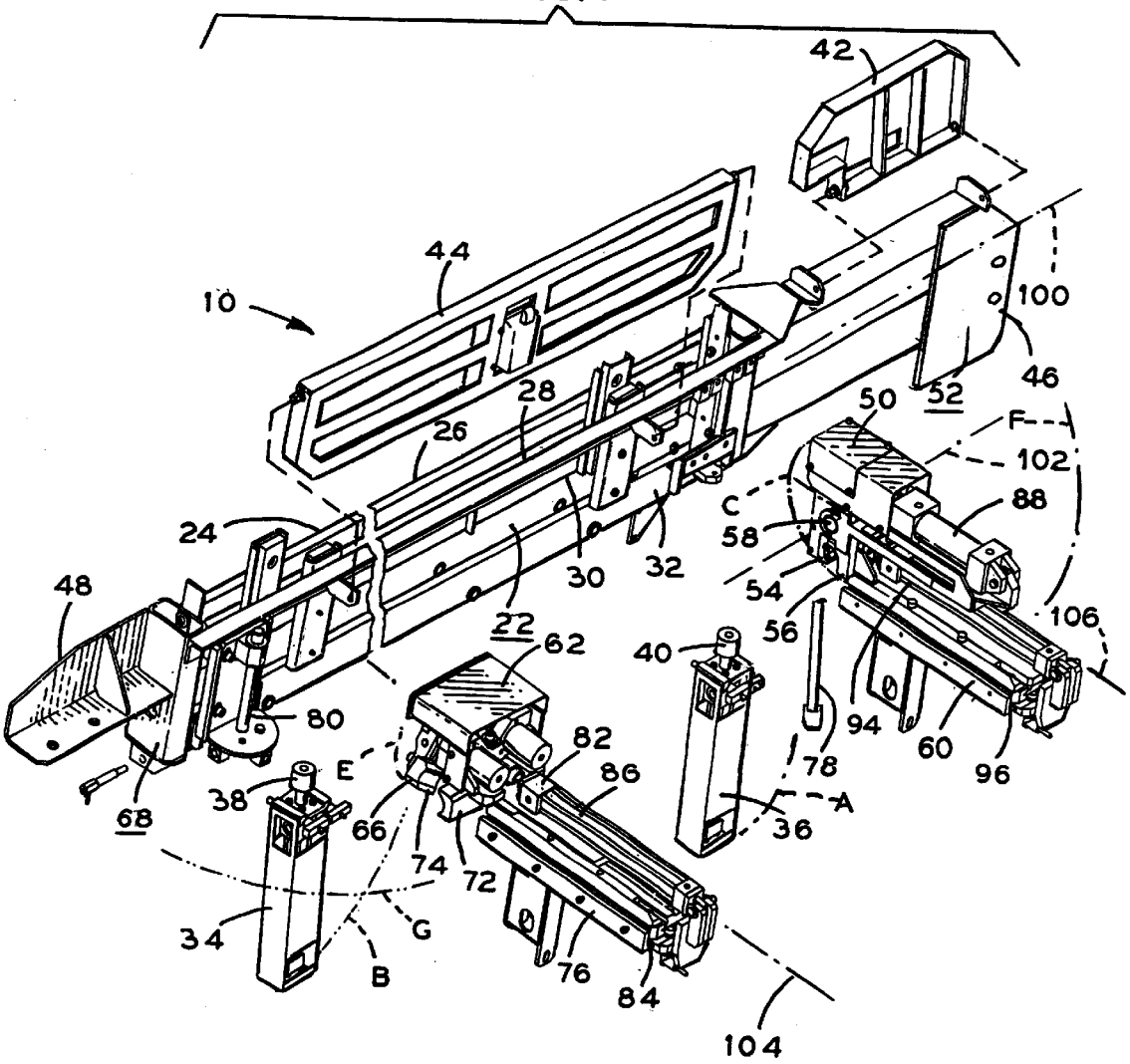
FIG. 3 is a partially exploded perspective view of an embodiment of the invention.

Turning now to FIGS. 2 and 3, the drill rod loader 10 is shown in greater detail. FIG. 2 is a drill side view of the loader 10. FIG. 3 is a partially exploded perspective view of the loader 10.

The loader 10 includes a rectangular box frame 24 having an axis of symmetry 100 comprised of two sets of spaced parallel supporting beams 26, 28, 30 and 32 plus conventional connecting hardware.

A pair of pivoted lift cylinders 34 and 36 are mounted to the underside of the beams 30 and 32. Each lift cylinder 34 and 36 includes a piston 38 and 40 respectively. The cylinders 34 and 36 are mid-mounted to the frame 24 so as to enable a plurality of rods 20 to be stored and raised up between the beams 26, 28, 30, and 32. That is, the beams 26, 18, 30 and 32 are spaced sufficiently apart to store approximately five rods 20 in storage compartment 22 and permit a rod 20 to pass through the interior of the box frame 24. Moreover, for ease of transport and assembly, the cylinder 34 and 36 may pivot through arcs A and B.

A back guard 42 and a side guard 44 are pivotally mounted to the frame 24 to protect personnel. Mounting plates 46 and 48 affix the loader 10 to the drill 12.

A clamp rod gripper 50 is mounted towards the distal end 52 of the box frame 24 and substantially opposite the cylinder 36. The clamp rod gripper 50 consists of a rotatable jaw 54 and a fixed jaw 56. See also FIGS. 7 and 8. The jaw 54 rotates about pivot 58 through arc C about pivot axis 102 to clamp and release the tube 20. The clamp rod gripper 50 grabs the rod 20 along the rod's longitudinal axis which is generally congruent with the axis of symmetry 100. The clamp rod gripper 50 is moved perpendicularly to the axis of symmetry 100 of the frame 24 and the rod 20 by transfer arm 60, along clamp rod gripper axis 106.

A swing gripper 62 consisting of a pair of opposed pendulum members 64 and 66 is mounted towards the proximal end 68 of the frame 24 and substantially opposite the lift cylinder 34. See also FIGS. 4, 5 and 6. Pendulum members 64 and 66 pivot through arcs D and E respectively which are parallel to the axis of symmetry 100 of the frame 24 to press against the rod 20.

Figure 14:
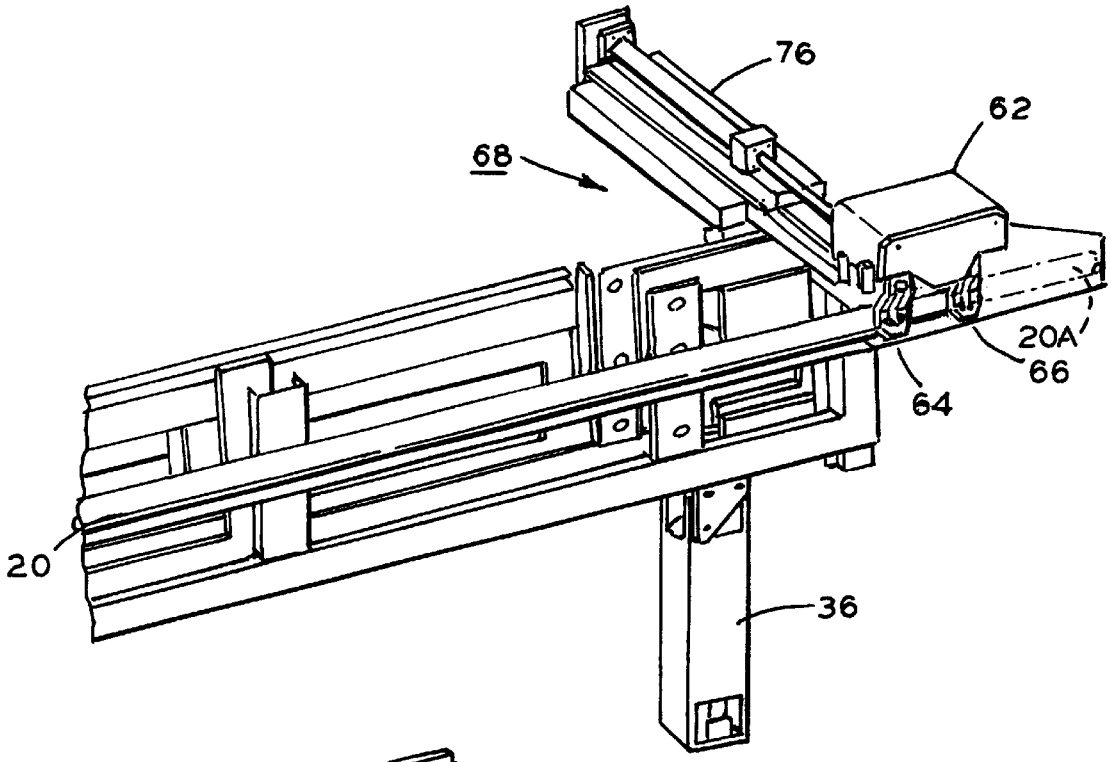
FIG. 14 is a perspective schematic view of an embodiment of the invention.

The pendulum member 64 includes moving arcuate block 70, fixed arcuate back block 72, and moving arcuate block 74. The block 74 is slightly longer than the block 70 so as to allow small variations in the position of the end of the existing rod. See FIG. 14. The swing gripper 62 is moved perpendicularly to the axis 100 of the frame and a rod 20 by transfer arm 76 along swing gripper axis 104.

Again, for ease of transport and space considerations, the clamp rod gripper 50 and the swing gripper 62 are pivotally mounted to the frame 24 via bars 78 and 80 and the associated mounting hardware. The two grippers 50 and 62 may rotate through arcs F and G respectively.

The cylinders 34 and 36 and the transfer arms 60 and 76 are pivotably mounted to the loader 10 to: a) keep the outer working envelope for the drill 12 as small as possible so that the drill 12 will fit into a mine cage without requiring disassembly; b) reduce the overall space required to set up a drill in a confined working area; c) prevent damage to any protruding members when the drill 12 is tramming from one location to another location; and d) minimize the impact on the available space at the drill 12 and the drillers' work area.

Figure 4:
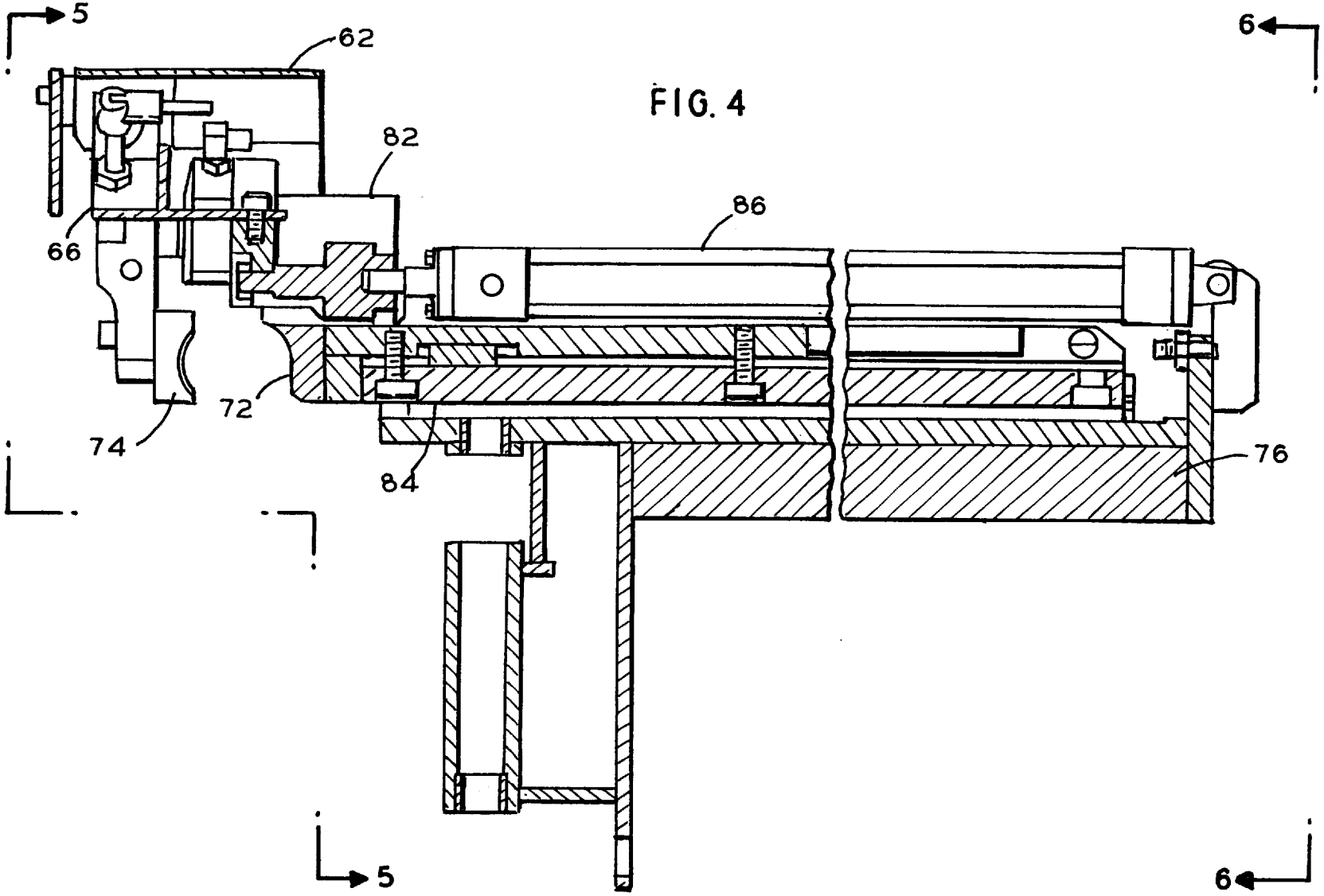
FIG. 4 is a partial sectional view of an embodiment of the invention.
Figure 6:
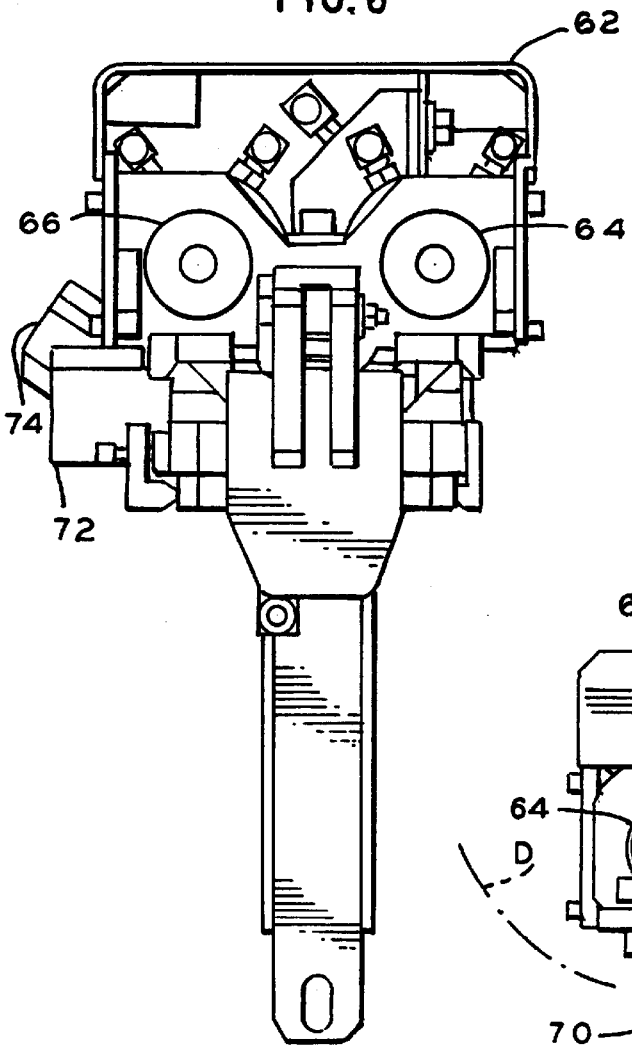
FIG. 6 is a view taken along line 6—6 in FIG. 4.
Figure 5:
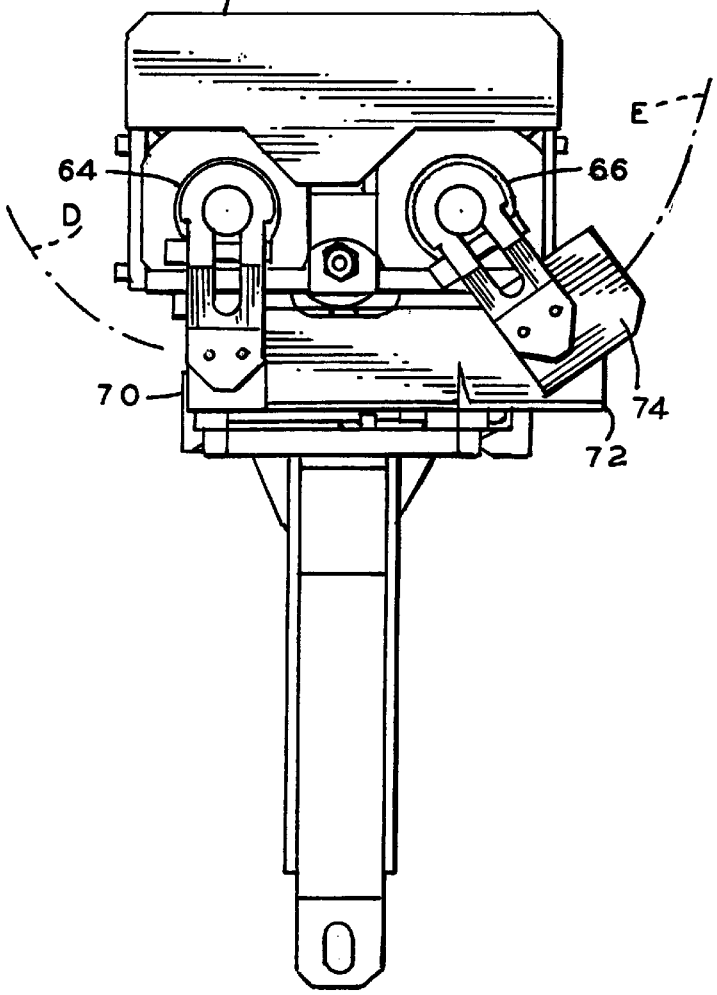
FIG. 5 is a view taken along line 5—5 in FIG. 4.
Figure 15:
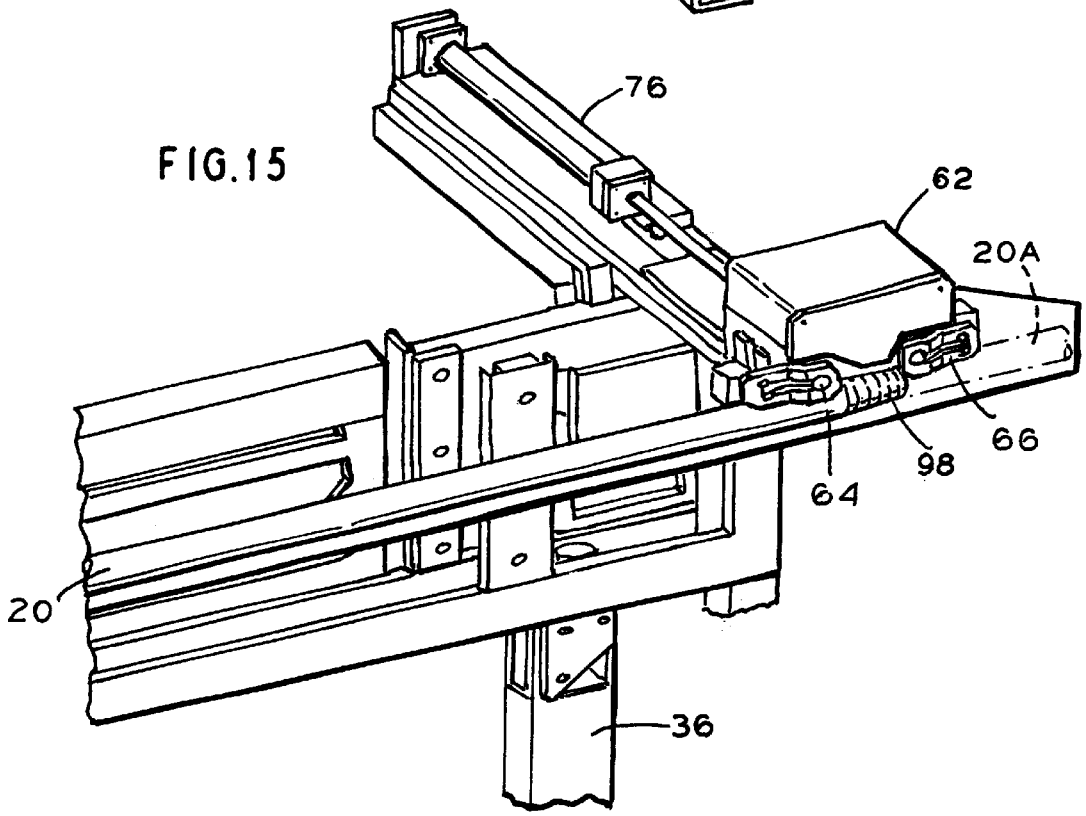
FIG. 15 is a perspective schematic view of an embodiment of the invention.

FIGS. 4, 5 and 6 show the swing gripper 62 in greater detail. The swing gripper 62 includes two Enerpac™ SURD121 and SURL121 hydraulically actuated pendulum members 64 and 66. The pendulum members 64 and 66 rotate through the opposing 90° stroke arcs D and E. The member 64 is shown in the vertical (0°) position whereas the member 66 is shown in the 45° position. However, both pendulums 64 and 66 can swing outwardly to a 90° position (See FIG. 15).

More particularly, the pendulum members 64 and 66 actuate as follows: there is 0.5 inches (1.27 cm) of straight stroke (motion is identical to a simple hydraulic cylinder), followed by a combination of rotation and stroke, so that during this segment, the pendulum member is actually moving forward as well as rotating. The pendulum members 64 and 66 have an internal cam mechanism which begins rotating the pendulums after the short initial straight stroke. The net effect is that the rod 20 can approach the rod 20A straight, preventing interference between the bottom curved portion of the arcuate blocks 70, 72 and 74.

The fixed arcuate back block 72 and the moveable arcuate blocks 70 and 74 are sized to circumscribe the outside diameter of the rod 20.

The entire swing gripper 62 may be moved perpendicularly to the box frame 24 along axis 104 by the transfer arm 74 via carrier 82 and slide 84. A hydraulic cylinder 86 translates the gripper 62 along the slide 84.

Figure 7:
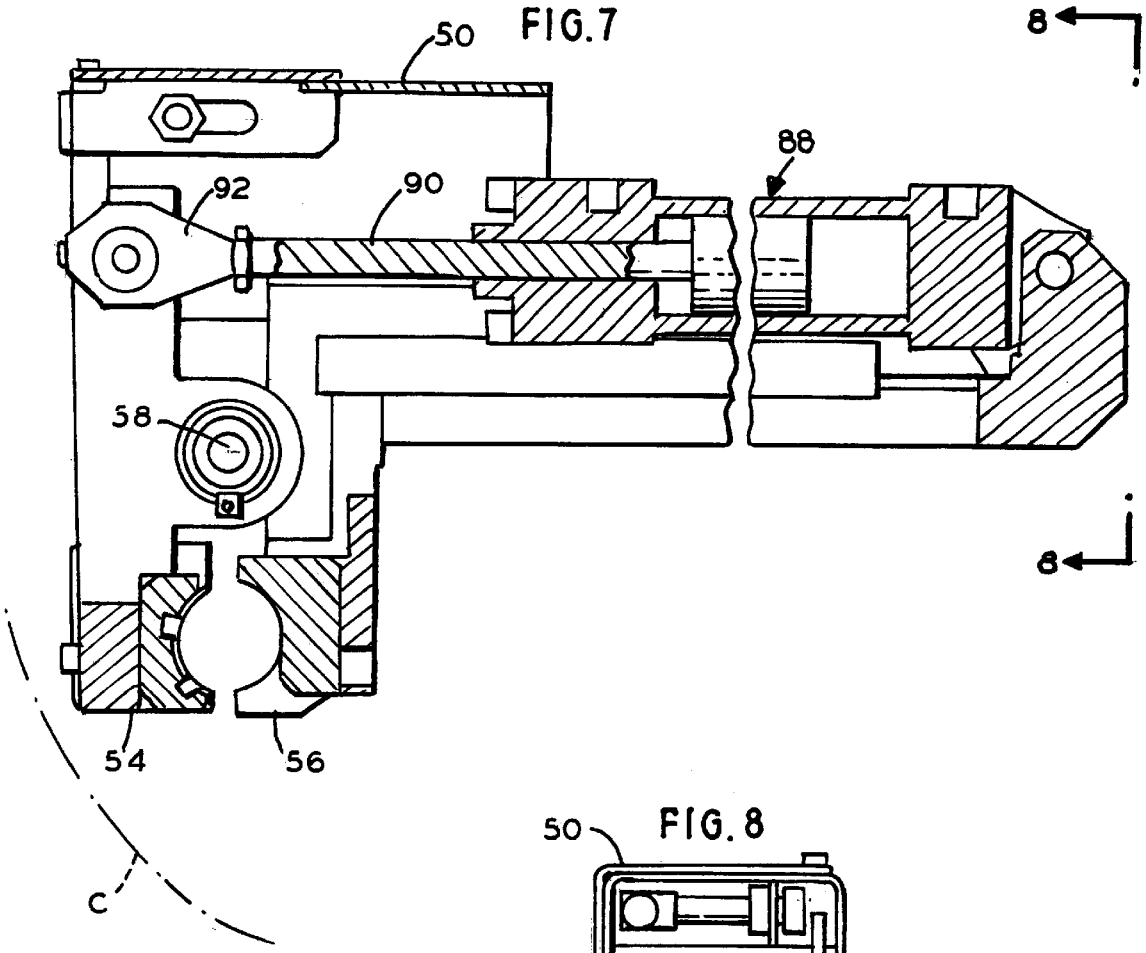
FIG. 7 is an elevation of an embodiment of the invention.
Figure 8:
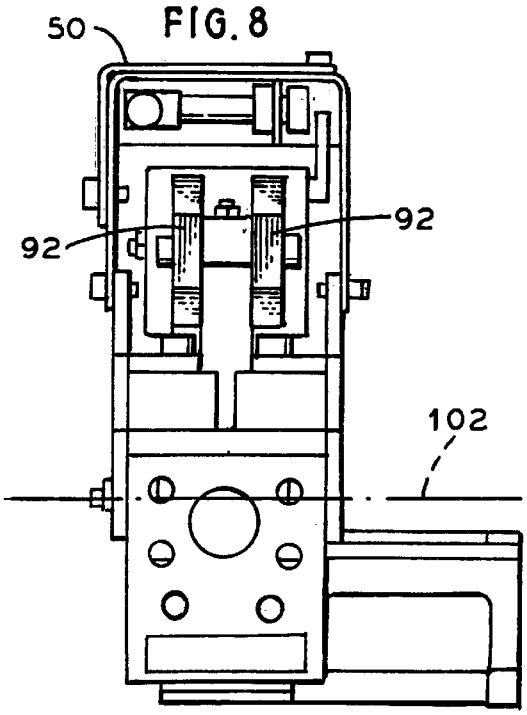
FIG. 8 is a view taken along line 8—8 in FIG. 7.
Figure 9:
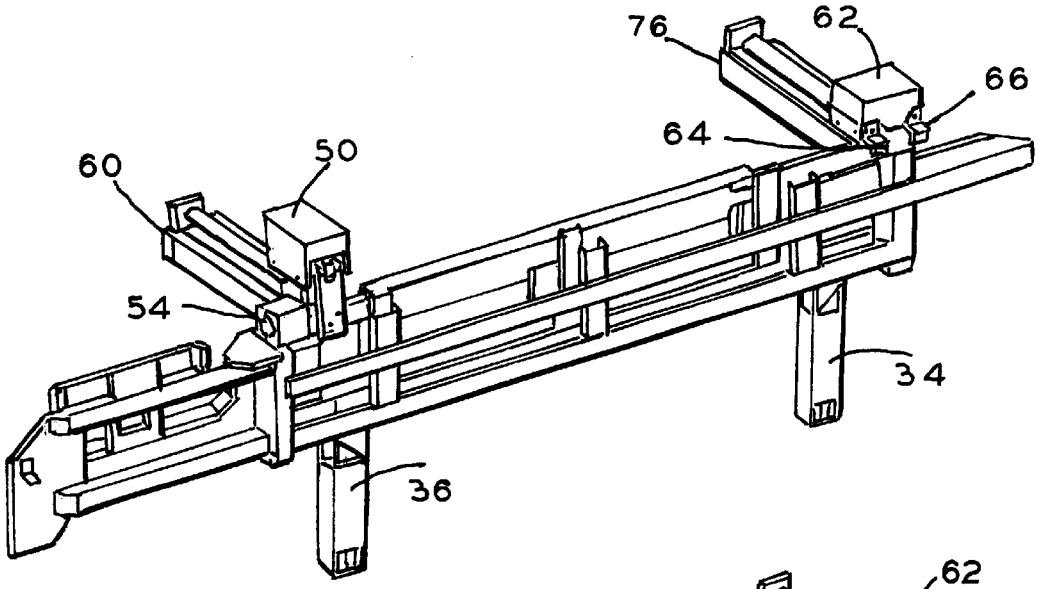
FIG. 9 is a perspective schematic view of an embodiment of the invention.
Figure 11:
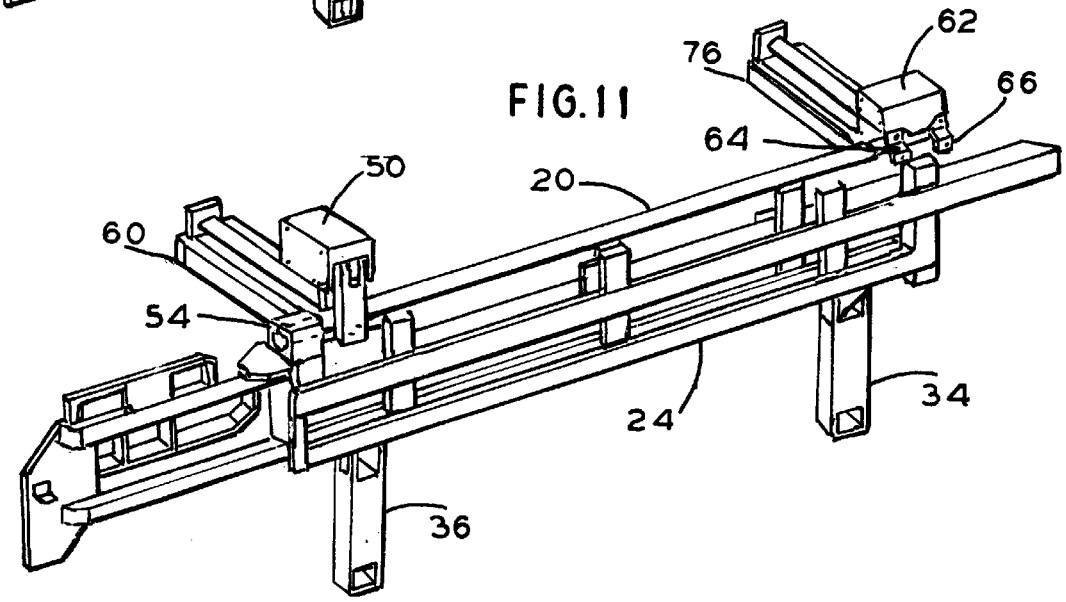
FIG. 11 is a perspective schematic view of an embodiment of the invention.
Figure 10:
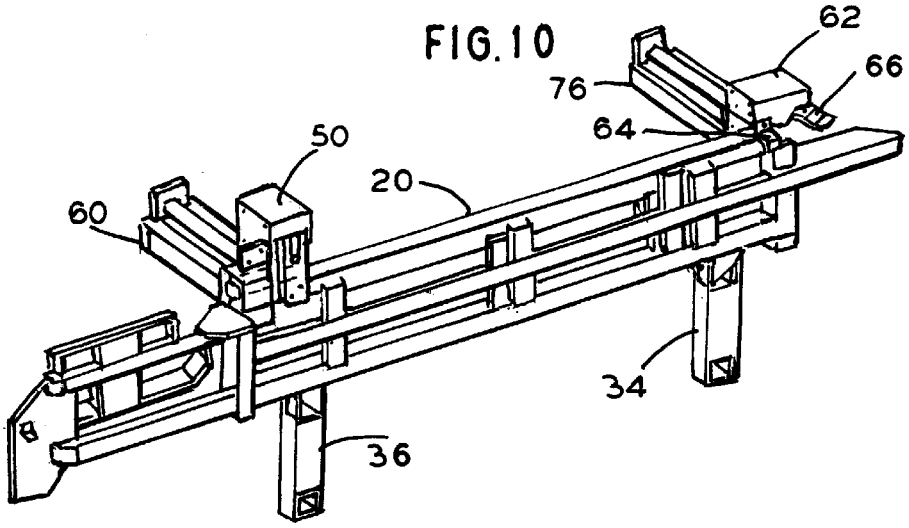
FIG. 10 is a perspective schematic view of an embodiment of the invention.
Figure 12:
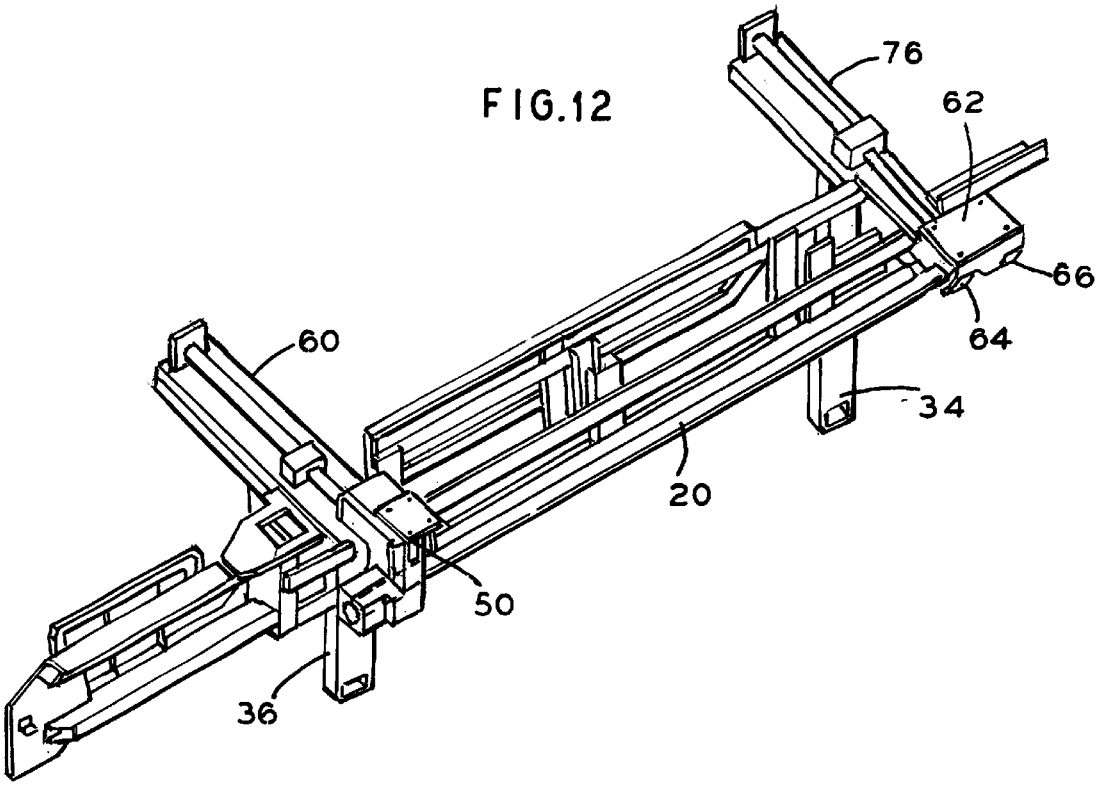
FIG. 12 is a perspective schematic view of an embodiment of the invention.
Figure 13:
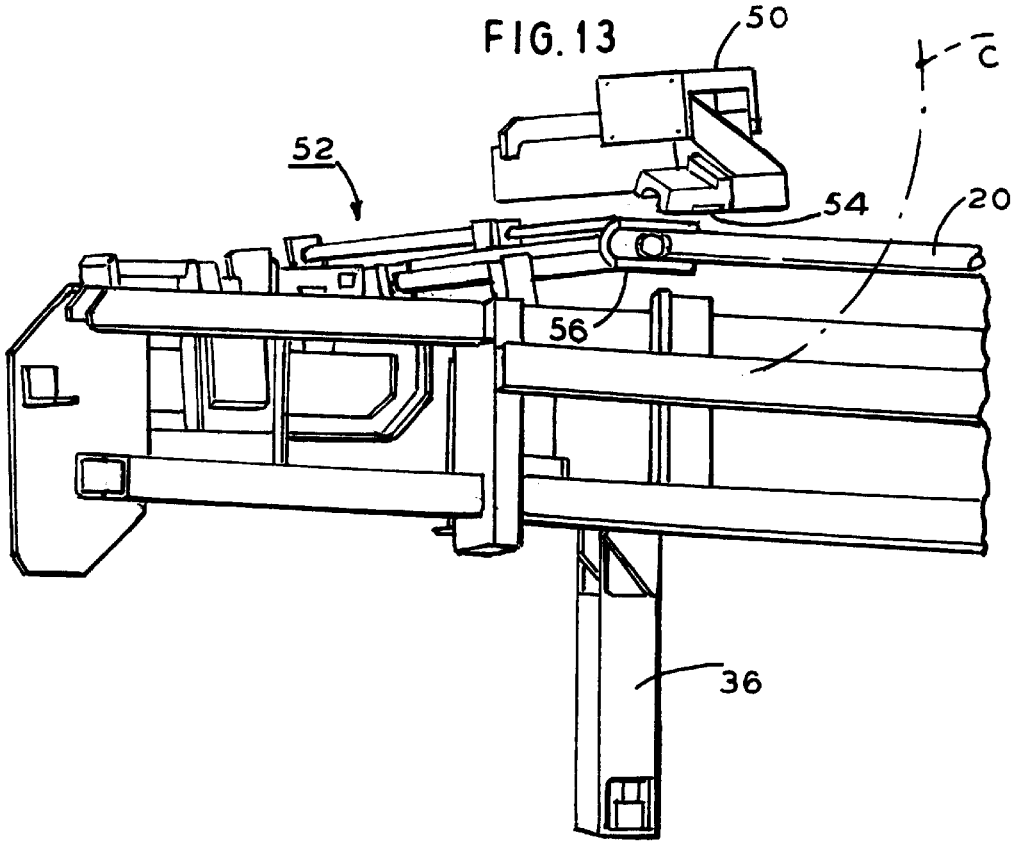
FIG. 13 is a perspective schematic view of an embodiment of the invention.

FIGS. 7 and 8 show the clamp rod gripper 50 in a partial cross section and a rear view respectively without the transfer arm 60. A hydraulic cylinder 88 and piston 90 rotate the jaw 54 about the pivot 58 and the axis 102 through the arc C via the action of knuckle 92. Both the arcuate rotatable jaw 54 and the arcuate fixed jaw 56 are sized to circumscribe the outside diameter of the rod 20.

The construction and function of the transfer arm 60 are similar to that of the transfer arm 76. In this instance, a hydraulic cylinder 94 drives the gripper 50 along slide 96 through axis 106.

In order to understand the operation of the drill rod loader 10, sequential schematic FIGS. 9–15 demonstrate the action of the loader 10. For purposes of clarity, the associated drill 12 and some of the components of the drill rod loader 10 are not shown. However, recall that the loader 10 is affixed to the mast 14 of the drill 12. In this fashion the loader 10 can store (via compartment 22), deliver, and couple rods 20 to the drill string.

The drill rod loader 10 is versatile because it can either start a drill string by connecting the first rod 20 to the drill 12 or it may continuously feed rods 20 to an existing drill string.

Figure 16:
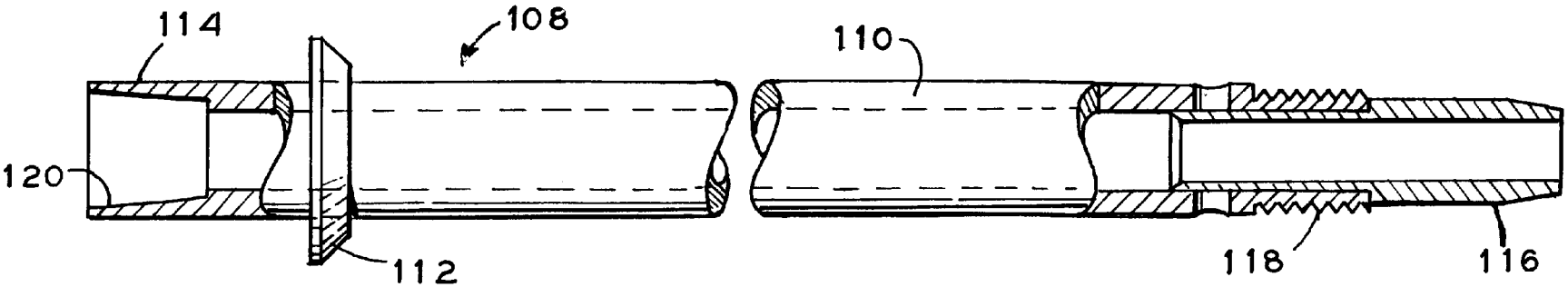
FIG. 16 is an elevation, in partial cross section, of an embodiment of the invention.

It is preferred to employ a unique chuck rod 108 with the loader 12. See FIG. 16.

The chuck rod 108 includes a hollow cylindrical body 110 having a circumferential flange 112 disposed toward the head end 114 of the body 110. The head end 114 includes a box 120.

The opposing end of the chuck rod 108 includes a tapered pin end 116 with a threaded section 118.

The chuck rod 108 is inserted into the rotary drive 16 of the drill 12. (See FIG. 1). The chuck rod 108 is used to provide a surface for clamping and driving the drill string. The walls of the chuck rod 108 are thicker than those of regular drill rods 20.

The chuck rod 108 determines joint location, ensures rod alignment during threading of the rotary drive 16 end joint and assists in maintaining radial alignment of the rods to prevent eccentric rotation of the drill string.

The goal of automated loading is to successfully add up to 30 feet (9.1 m) of rods to the drill string without human intervention. The system must be capable of complex handling sequences usually accomplished by a person with two hands and easy access to a control panel. The rod loader 12 is a successful blend of abilities to control all movements of rods and to establish and maintain positions of these elements.

Components must at all times be rigidly held or they will be dropped during the threading process. For example, if the rotary drive 16 were to let go of the chuck rod 108 before it is connected to the adjacent rod 20, it will drop. This means not only control of the chuck rod is lost, but also that it must be carefully repositioned relative to the head before continuing.

The control system must know where all components are and use those preset positions to prevent collisions. All positions that can change during automated operations must be able to be re-established either by the use of rigid stops or by the use of measuring instruments.

The drill 12 determines position. An LVDT (linear variable displacement transducer) can measure the position of the drive 16 at any point on the mast 14 to within tight tolerances and report this position to the control system.

An example of a rigid stop is the chuck rod 108. If the chuck rod 108 is in the drive 16 and is also fully threaded into the last rod 20 in the drill string, the position of the joint between the chuck rod 108 and the last rod 20 can be calculated. This is done by noting the position of the head using the LVDT, then adding the distance between this point and the flange 112 on the chuck rod 108 thread.

It is critical to note that at any point in the rod addition sequence, all parts must be rigidly held to prevent them from dropping and jamming in the mechanisms, and that it is possible for incorrectly timed movements to cause collisions. This is complicated by the fact that there are only small clearances between moving parts.

The rods used in AQ diamond drilling are long (61.63 inches [156.5 cm]) and the mast 14 has been designed to be as short as possible leaving little room to spare for loading operations. The rods added to the drill string are inserted between the chuck rod 108 and the last rod 20A in the hole. This space is up to 70 inches (178 cm) long, leaving a small clearance at each end of the rod for alignment and threading operations.

There are a number of steps required for loading a new rod.

These steps are as follows:

A. Setting up the drill and establishing the home positions for all automated equipment.

B. Loading the new rod into a location that lines it up between the chuck rod and the last rod.

C. Joining the chuck rod to the new rod (threading the head end joint).

D. Setting up new home positions to allow threading of the new rod to the last rod.

E. Threading the new rod to the last rod (threading the foot clamp end joint).

F. Setting up new home positions to begin drilling.

Once these steps are accomplished, the drill string is one rod longer, and the system is ready for drilling. These steps are described in more detail below:

A. Start Position and Setup

1. The drill 12 finishes drilling the last rod 20A. The drive 16 is clamped to the chuck rod 108 and is now at the end of its travel, near the foot clamp 18. The foot clamp 18 is open. No further drilling can occur without adding a rod to the drill string.
2. The operator places the drill in automated rod loading mode and automated functions begin.
3. The foot clamp 18 closes on the last rod 20A.
4. The drive 16 moves back to the flange 112 on the chuck rod 108, its position is recorded.
5. A control system verifies that the joint position (drive 16 position plus the fixed distance to the pin end 116) is in an acceptable position for the rod loader to function.
6. If the joint is not in the correct position, either the drill 12 can attempt to drill further, or it can pull the drill string back to the correct position.
7. If the last joint is correctly positioned, the drive 16 closes on the chuck rod 108 and carefully unthreads (breaks) the joint between the chuck rod 108 and the last rod 20A in the drill string. The foot clamp 18 is supporting all the rods in the hole.
8. While still holding the chuck rod 108 (and the water swivel 8 which is rigidly attached to it) the drive 16 moves the back end of the mast 14, and positions itself correctly.

At this point there is enough room for the new rod 20 to fit between the end of the chuck rod 108 and the last rod 20A in the drill string.

B. Leading the New Rod

1. The grippers 50 and 62 move into the "receive rod position". See FIGS. 9 and 10. The clamp rod gripper 50 is open enough to allow rod 20 to be indexed up into it. The pendulum 64 is in a similar position. The pendulum 66 is fully closed which will prevent a rod 20 from sliding out of the transition zone between the grippers 50 and 62 and the storage position within the compartment 22.
2. The rod loader 10 indexes a rod 20 into the grippers 50 and 62 and they close on the rod 20. Pendulum 66 opens fully to allow it to get by the last rod 20A once the transfer arms 60 and 76 start moving. See FIG. 10.
3. The transfer arms 60 and 76 move the rod 20 to the drill string axis of symmetry 100. The pendulum 66 which is fully open as stated above, passes over the top of the last rod 20A in the hole and is ready to be clamped. The arcuate jaw 72 contacts the two rods 20 and 20A.
4. The pendulum member 66 closes on the rod 20A, aligning the new rod 20 to the drill string. See FIGS. 12 and 14.

C. Threading the Box (Female) End of the New Rod 20

1. The drive 16 (still rigidly clamped to the chuck rod 108) moves toward the new rod, the pin end 116 enters the box end (not shown) of the rod 20. At this point, there is sufficient clearance radially to allow up to about ⅛ inch (0.32 cm) of misalignment between the chuck rod 108 and the rod 20.
2. As the chuck rod 108 advances, the rod 20 moves radially as forced by the pin end 116 until both rods 108 and 20 are aligned for threading. The drive 16 rotates the chuck rod 108 into threaded connection with the rod 20.

The drive 16 may now let go of the chuck rod 108 since it is connected to the rod 20 which in turn is rigidly held by the grippers 50 and 62. The top joint has been successfully made up. The next step is thread the opposite end of the rod 20 into the rod 20A.

D. Setup to Thread the New Rod 20 to the Existing Rod 20A

1. The clamp rod gripper 50 opens, the transfer arm 60 retracts, the jaw 54 resets to receive the next rod. See FIGS. 12 and 13.
2. The drive 16 unclamps and advances past the joint between the chuck rod 108 and the rod 20 and clamps down on the new rod 20.
3. The drive 16 is now supporting the weight of the chuck rod 108, the water swivel 8 and the rod 20 along with the swing gripper 62.
4. The pendulum member 64 pulses slightly open in preparation for it to act as a guide to prevent excessive misalignment between the new rod 20 and the rod 20A (still held by the foot clamp 18).

The end of the new rod 20 is in the confined space defined by the slightly open pendulum member 64 and the arcuate jaw 72. In this manner, the new rod 20 is forced into alignment with the rod 20A.

E. Threading the New 20 Rod into the Existing Rod 20A

1. The drive 16 forces the chuck rod 108, water swivel 8, and new rod 20 toward the existing rod 20A. The threads meet and the drive 16 rotates the rod 20 into the rod 20A.
2. All the connections are fully threaded. The drive 16 releases its hold on the drill rod 20. The foot clamp 18 holds the rods 20 and 20A in the hole about the rod 20A. See FIG. 14 (pendulum member 66 is shown in the clamped position).

F. Setting Up for Drilling

1. Both of the pendulum members 64 and 66 open fully, clear of the newly lengthened rod string.
2. The swing gripper transfer arm 76 retracts, both pendulum members 64 and 66 reset to 'receive rod' positions, and the transfer arm 76 fully retracts to its position over the rod storage area 22.
3. The drive 16 unclamps and translates back up the mast 14 until it bumps up against the flange 112 on the chuck rod 108.
4. The drive 16 clamps on the chuck rod 108 and torques up both of the joints to ensure that they are all tight.
5. Drilling commences.

The loader 10 is preferably capable of delivering five new rods 20 to the drill string in this fashion.

It should be appreciated by those skilled in the art that the various components may be replaced or augmented by similar acting devices. For example, the hydraulic systems may be replaced by pneumatic or electrical actuators. Moreover, the loader 10 may be used with drills and rods other than the diamond drill 12 discussed herein.

In the event a new drill string is to be established, the storage component 22 must be sized to accommodate a first drill rod with the bit and related components attached.

For diamond drills, the business end of the first rod includes a number of components making it difficult to store and pass the rod through the frame 24. However, for non-diamond drills, the first rod is shorter than a standard drill rod to allow the compartment 22 to accommodate the rod/bit combination of the first rod. The shorter top (last) rod, inserted into the cartridge 22 last so as to be on top of the other rods, would include the bit fitted thereto. The rod/bit would be offered to the rotator drive 16 in the manner previously described and the hole started. The subsequent normal length rods 20 would then be attached in the manner described.

The drill rod loader 10 may be partially or fully automated by the use of manual controls, computerized controls or any combination thereof. At its most basic, a simple control panel connected to the various components such as the actuators 34 and 36, transfer arms 60 and 76 and the grippers 50 and 62, in conjunction with the drill 12 control system, would enable an operator to raise up a rod 20 from the compartment 22, energize the footclamp 18, uncouple the rotation drive 16 from the drill string, place the rod 20 in position and torque it to its neighbor.

A computerized drill rod loader 10 permits the connect cycle to be fully automated with little or no manual assistance. With the appropriate sensors and software packages, the drill 12 determines when the next drill rod 20 is needed and the foot clamp 18 clamps the rod in the hole, stops the drill 12, delivers and connects the new drill rod 20 into the string, at which time the drilling cycle commences anew.

In accordance with the provisions of the statute, the specification illustrates and describes specific embodiments of the invention. Those skilled in the art will understand that changes may be made in the form of the invention covered by the claims; and that certain features of the invention may sometimes be used to advantage without a corresponding use of the other features.

The embodiments of the invention in which an exclusive property or privilege is claimed are defined as follows:

1. A rod loader for manipulating rods, the rod loader comprising an open elongated frame including two spaced parallel beams to accommodate the passage of a rod therebetween, the frame having a distal end and a proximal end and a longitudinal axis of symmetry extending therethrough, a clamp rod gripper affixed adjacent to the distal end of the frame, the clamp rod gripper including a rotatable jaw juxtaposed about a pivot and an opposed fixed jaw, the pivot having an axis of symmetry substantially parallel with the axis of symmetry of the frame, the rotatable jaw sized to accommodate a rod, the opposed fixed jaw sized to accommodate a rod, means for actuating the rotatable jaw, the clamp rod gripper affixed to a first transfer arm, the first transfer arm adapted to move the clamp rod gripper substantially perpendicular to the axis of symmetry of the frame through a predetermined distance, a swing rod gripper affixed adjacent to the proximal end of the frame, the swing rod gripper including two adjacent pendulum members affixed thereto, the pendulum members pivotally mounted to the swing rod gripper to rotate in an arc about an axis at least substantially perpendicular to the axis of symmetry of the frame, means for extending and rotating the pendulum members, the swing rod gripper including a fixed block, each pendulum member including a pendulum block, and the fixed block and the pendulum blocks are sized to accommodate a rod, the swing rod gripper affixed to a second transfer arm, the second transfer arm adapted to move the swing rod gripper substantially perpendicular to the axis of symmetry of the frame through a predetermined distance, and means for retrieving and indexing a rod.

2. The rod loader according to claim 1 wherein the clamp rod gripper and the swing rod gripper are pivotally affixed to the frame.

3. The rod loader according to claim 1 including means for affixing the rod loader to a drill.

4. The rod loader according to claim 1 including a chuck rod affixed to the rod.

5. The rod loader according to claim 1 wherein an actuator affixed to the loader passes a rod through the frame.

6. The rod loader according to claim 5 wherein the actuator is pivotally affixed to the frame.

7. An automated drill rod loader for positioning drill rods in a drill string, the loader comprising an open box frame having a longitudinal axis of symmetry with side beams spaced at least sufficiently apart forming an interior therein to permit drill rods to pass through substantially parallel to the longitudinal axis of symmetry, an actuator for passing drill rods through the interior of the open box frame, a clamp rod gripper affixed to the frame, the clamp rod gripper including first and second opposed surfaces shaped to accommodate a drill rod therebetween, the first opposed surface fixed in position, the second opposed surface pivotally mounted to the clamp rod gripper to rotate about an axis substantially parallel to the longitudinal axis of symmetry, a swing rod gripper affixed to the frame, the swing rod gripper including a fixed first surface and movable opposed second and third surfaces, the first, second and third surfaces shaped to accommodate a drill rod, the second and third surfaces rotatably mounted to the swing rod gripper to rotate about an axis substantially perpendicular to the longitudinal axis of symmetry, means for moving the clamp rod gripper and means for moving the swing rod gripper substantially perpendicular to the longitudinal axis of symmetry of the box frame, and means for attaching the drill rod loader to a drill.

8. The automated drill rod loader according to claim 7 wherein a chuck rod is affixed to the drill rods.

9. A method for establishing a drill string connected to a drill, the method comprising:

(a) providing a drill rod loader having a longitudinal axis of symmetry, the drill rod loader comprising:
  i) a clamp rod gripper including first and second opposed surfaces shaped to accommodate a drill rod therebetween, the first opposed surface fixed in position and the second opposed surface pivotally mounted to the clamp rod gripper to rotate substantially perpendicularly to the drill rod loader's longitudinal axis of symmetry; and
  ii) a swing rod gripper including a fixed first surface and opposed movable second and third surfaces, the first, second and third surfaces shaped to accommodate a drill rod, the second and third surfaces rotatably mounted to the swing rod gripper to rotate substantially parallel to the drill rod loader's longitudinal axis of symmetry;

(b) providing a rod storage compartment adjacent to the drill rod loader and a drill motor adapted to rotate a drill rod;

(c) transferring a drill rod from the rod storage compartment to the clamp rod gripper and the swing rod gripper of the drill rod loader;

(d) substantially simultaneously rotating the clamp rod gripper into engagement with the drill rod about an axis substantially perpendicular to the drill rod loader's longitudinal axis and slidably pressing the swing rod gripper against the drill rod substantially parallel to the drill rod loader's longitudinal axis;

(e) moving the swing rod gripper and the clamp rod gripper perpendicularly to the longitudinal axis of the drill rod loader to index the drill rod into a position for establishing a drill string;

(f) releasing the drill rod from engagement with the clamp and swing rod grippers;

(g) withdrawing the clamp and swing rod grippers;

(h) performing steps (c)–(g) with an additional drill rod;

(i) connecting the drill rod and the additional drill rod together by actuating the drill motor; and (j) repeating steps (h) and (i) until a desired length of drill string is established.

10. The method according to claim 9 including rotating a drill rod with the drill motor to connect drill rods together.

11. The method according to claim 9 including offering a rod/drill bit combination to the clamp and swing rod grippers.

12. The method according to claim 9 including inserting a chuck rod into the drill motor and affixing the chuck rod to a drill rod.

* * * * *